United States Patent [19]

Brown et al.

[11] Patent Number: 4,981,166

[45] Date of Patent: Jan. 1, 1991

[54] FOUNDRY PAPER RISER AND SYSTEM THEREFOR

[75] Inventors: Robert G. Brown; Phillip R. McCarthy, both of Fairhope, Ala.

[73] Assignee: Brown Foundry Systems, Inc., Fairhope, Ala.

[21] Appl. No.: 372,252

[22] Filed: Jun. 27, 1989

[51] Int. Cl.[5] ..... B22D 33/04; B22C 9/08

[52] U.S. Cl. ..... 164/5; 164/137; 164/359; 164/412

[58] Field of Search ..... 164/5, 137, 349, 359, 164/360, 412

[56] References Cited

U.S. PATENT DOCUMENTS

| | | | |
|---|---|---|---|
| 2,198,498 | 4/1940 | Hagemeyer | 164/412 |
| 2,269,455 | 1/1942 | Hagemeyer | 164/412 |
| 3,526,266 | 9/1970 | Snelling | 164/34 |
| 4,081,168 | 3/1978 | Atterbury | 164/137 |
| 4,318,437 | 3/1982 | Kemp | 164/122 |
| 4,598,757 | 7/1986 | Bailey | 164/412 |
| 4,682,644 | 7/1987 | Ueno | 164/359 |

FOREIGN PATENT DOCUMENTS

| | | | |
|---|---|---|---|
| 2803247 | 7/1979 | Fed. Rep. of Germany | 164/359 |
| 3039935 | 5/1982 | Fed. Rep. of Germany | 164/359 |

OTHER PUBLICATIONS

Catalog No. 100 of Brown Foundry Systems, Inc., (undated).

Bulletin No. 200 of Brown Insulating Systems, Inc., (undated).

Two undated Brochures of Brown Insulating Systems, Inc., Reprinted from Commercial Advertisements (undated).

*Primary Examiner*—Richard K. Seidel

*Assistant Examiner*—Rex E. Pelto

*Attorney, Agent, or Firm*—Body, Vickers & Daniels

[57] ABSTRACT

A paper sleeve and system for application as an insulated riser in a sand mold used to cast metal articles is disclosed. The sleeve, preferably cylindrical, is formed from a plurality of sheets of paper wrapped around one another with, preferably, a space between the edges of each sheet to provide a plurality of spaces or openings extending through the sleeve. Each sheet is treated with a precise amount of fire retardant. The sleeve for a given time period acts as an insulator keeping metal therein liquid until the metal solidifies in the article forming cavity of the sand mold and thereafter decomposes or reduces itself to a harmless carbon ash. The sleeve can function to both feed liquid metal to the article forming cavity in a sand mold and also to supply additional liquid metal to the article cavity upon solidification of the metal therein to eliminate the need for separate risers as now required in conventional foundry practice.

13 Claims, 3 Drawing Sheets

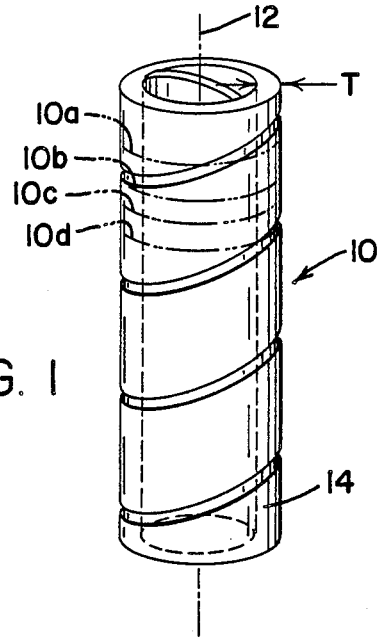
FIG. 1
FIG. 2
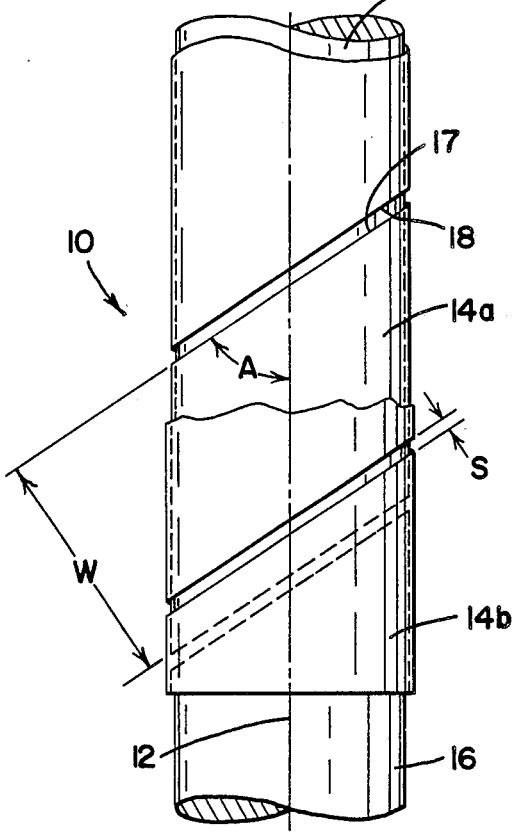
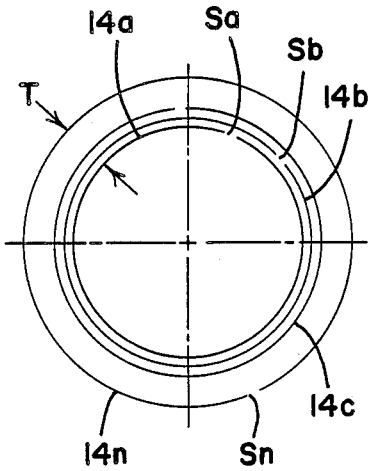
FIG. 3

FOUNDRY PAPER RISER AND SYSTEM THEREFOR

This invention relates generally to an insulated sleeve for use in sand molds where metal castings are formed and more particularly to an improved sleeve and casting system for use therewith.

The invention is particularly applicable to automatic sand molding machines and will be described with particular reference thereto. However, the invention has broader application and can be used for any foundry sand mold whether the mold be hand formed as for large castings or made in an assembly line fashion by automatic molding machines.

INCORPORATION BY REFERENCE

The following documents are incorporated by reference herein:

(1) Catalog No. 100 of Brown Foundry Systems, Inc., undated (2) Bulletin No. 200 of Brown Insulating Systems, Inc., undated (3) Two undated brochures of Brown Insulating Systems, Inc. reprinted from commercial advertisements, undated.

BACKGROUND OF THE INVENTION

Casting metal articles by sand molds is an old process which has developed as an art into practices and procedures too numerous to mention herein. However, for the sake of consistent terminology, at least as to the terminology used herein, every sand mold casting process uses a pattern having an article form shape about which sand is packed so that when the pattern is removed from the mold an article forming cavity is formed in the mold. The mold has two parts, referred to herein as cope and drag, the intersection of which forms the casting parting line. After the sand is packed around the pattern, the pattern is removed and any cores which define cavities in the cast article are inserted into the article forming cavity made by the pattern. The mold is then "reassembled" and the metal poured.

Each pattern has a gating system which includes a sprue, feeders, runners and riser. Minimally, a sprue and a riser are required to be formed in the sand mold when the article forming cavity is such that a thin casting section feeds a thick casting section. The sprue and riser are in fluid communication with the article forming cavity such that liquid metal is poured from the sprue through the article forming cavity into the riser. The riser is termed an open riser when it extends above the mold so that the foundry man can stop pouring the mold when he sees metal in the riser. Risers positioned within the mold and out of sight are termed "blind" risers.

Metal undergoes volumetric contraction when it solidifies. When a casting has thick/thin sections, the thin sections solidify and contract before the thick sections. When a casting has a thick section fed from a thin section it cannot draw metal from the solid thin section to compensate for its volumetric contraction. A riser is thus used to feed metal to the thicker section to avoid shrinkage. Volumetric contraction of castable metals is about five percent. Shrinkage, of course, has nothing to do with hot spots, tears or cracks which occur between thick/thin casting sections because of differential casting cooling rates and which relate, generally, to casting design. Shrinkage, on the other hand, is a foundry art controlled by sprue, runner and riser position. As a matter of conventional foundry practice and irrespective of whether or not a thin casting section is feeding a thick sections, a riser is always provided adjacent a thick section to avoid shrinkage. In some instances where very thin sections in a casting (i.e. fins on a casting) are poured, a runner may directly feed the thin section without a riser attached to the thin section. Solidification is obviously very rapid and metal contraction not a significant problem.

Foundry sand does not possess good insulating characteristics. Densely compacted foundry sand has a K factor (i.e. a heat transfer factor) which varies from 0.6 to 1.2 depending on the density and moisture content. The value of the K factor is such that the foundry sand acts as a chill or heat sink. This means that conventional risers formed in the foundry sand mold must contain a larger mass of metal than what may otherwise be required to insure that the metal in the riser remains liquid until the casting section which the riser feeds has solidified.

The prior art has developed sleeves which are inserted into the mold and which act as risers. The purpose of the sleeve is to keep the metal in the sleeve in a liquid state to feed the thick casting sections. The prior art sleeves are able to do this with less metal than the metal required in a conventional, sand formed riser.

Metal reduction by means of a riser sleeve provides several advantages to the foundry which is not readily apparent at first glance. That is, because the risers are simply cut off from the casting and remelted in the next heat, the initial thought is that there is no practical advantage to be gained by reducing scrap which is simply being recycled. However, risers, especially risers for large size castings, can represent a significant proportion of the weight of the casting. Energy must then be used in the melt furnace to heat metal which is essentially scrap. Further, since a portion of the melt furnace must be used to produce waste, capacity of the furnace is reduced to a level which is less than what is otherwise possible. Also, since the riser mass is larger than what is otherwise possible, thicker riser sections must be removed from the casting which increases the foundry's finishing cost. Also, if the foundry is casting different heats requiring significantly different and tightly controlled alloy compositions, it may not be possible to obtain the desired chemical properties for castings to be poured from a given heat if scrap metal from a prior heat of an incompatible chemistry is used. This could require inventory control for the scrap, further increasing foundry cost.

There are two types of sleeves in commercial use by foundries today. One sleeve is known as an exothermic sleeve. This sleeve is made of foundry sand impregnated with metal particles, such as aluminum and/or iron oxide, which produce an exothermic reaction. The sand, binder and metal particles are formed into a sleeve insulated as a riser in the mold. The underlying theory for such sleeves is that the sleeve itself will supply heat to the riser metal to keep the riser metal liquid. In theory, this would appear an acceptable solution to the problem. However, in practice, it is not. First, before the sleeve can generate an exothermic reaction, the sleeve must be heated to that temperature range whereat the exothermic reaction can occur. Thus, the metal in the riser sleeve must drop in temperature to give up its heat so that the sleeve can be heated. Second, the temperature of the exothermic reaction for the metals which can be economically used in the sleeve is about 2000° F. which is below the liquid point of most castable metals. Thus, the use of such sleeves is limited to foundries other than aluminum or in castings where very large risers must be used. In the latter instance, it is conceivable that the temperature gradient from riser center to riser wall could, in theory, be somewhat affected by an exothermic sleeve to maintain a liquid core. In practice, however, because of the low exothermic temperature, a very large diameter riser sleeve has to be employed. Furthermore, the aluminum oxide and iron oxide can contaminate the foundry sand and sometimes produce agglomerates and/or fines which adversely affect the sand reclamation cycle.

A second type of sleeve which has experienced commercial success is an insulating as opposed to an exothermic sleeve. One such insulating sleeve was pioneered and developed by one of the inventors and was marketed by companies known as Brown Foundry Supplies, Inc. and Brown Insulating Systems, Inc. and is now being marketed today. Because the invention herein can be viewed as an improvement to the Brown liquid riser concept, attached hereto as a part hereof and incorporated by reference herein is Catalog 100 of Brown Foundry Supplies, Inc.; Bulletin 200 of Brown Insulating Systems, Inc.; and two advertisements for Brown Insulating Systems, Inc., which more specifically define the Brown insulated riser.

Generally, the insulated riser is a ceramic sleeve which is inserted as a riser in the sand mold to reduce riser size while maintaining the riser function of preventing shrinkage within the casting. Unlike the exothermic sleeve, the insulating sleeve has a composition which resists transfer of heat by conduction through the sleeve to the foundry sand in the mold which acts as a heat sink. The K factor for the Brown insulated ceramic sleeve is 0.072. By insulating the riser metal, the riser metal stays liquid a longer time than it otherwise would as a mass of metal in direct contact with the foundry sand. Because volumetric contraction upon metal solidification is only about five percent, the metal mass of the riser can be significantly reduced with an insulating riser sleeve.

The ceramic sleeves are used for both blind and open risers. In conjunction with the sleeves there are also provided reducers and caps covering the open end of the sleeve. Also, ceramic sleeves, while typically supplied in cylindrical form, have also been supplied as a truncated cone to achieve maximum metal reservoir with minimum contact area with the article form cavity. Ceramic sleeves and the reducer and cap accessories can be reclaimed and recycled with the foundry sand.

In summary, the insulating ceramic sleeve risers now in use have proven conceptually sound, economically viable and commercially acceptable. However, there are limitations besides the obvious price considerations associated with the sleeves. Ceramic insulating sleeves cannot be used in automatic molding machines which conventionally form risers, runners and sprues from sand. In automatic molding machines, the mold is formed by compressing sand against pattern plates which are carefully removed and in a precise manner, the mold halves are accurately mated, with or without cores, to form the completed mold. The outside diameter of ceramic insulating sleeves cannot be held to the tight tolerances which automatic molding machine applications require when positioning the mold halves and inserting the cores. In addition, the surface of the Brown ceramic insulating sleeves are rough in texture and this further compounds accurate placement of the sleeves in a mold formed by an automatic sand mold machine. Significantly, pressures of 1200 to 1400 psi are typically used in automatic molding machines as the molds are constructed and the cores are set. Ceramic sleeves cannot withstand such pressures and fail.

SUMMARY OF THE INVENTION

Accordingly, it is a principal object of the present invention to provide an improved insulating sleeve.

This object along with other features of the invention is achieved by means of an insulated paper sleeve adapted to be inserted as a riser in a foundry sand mold for casting metal articles. Alternatively stated, a sand mold having an article forming cavity used in a foundry to cast metal articles in the cavity is provided in combination with a paper sleeve to be inserted into the mold for containing metal poured into the mold which metal does not form part of the molded metal article. More specifically, the paper sleeve, preferably in the form of a cylinder, includes a plurality of paper sheets or plies which are laminated or wrapped in overlying relationship so that the number of sheets determine the thickness of the annular wall section of the sleeve. In accordance with a particularly important aspect of the invention, the sheets are wrapped in a manner such as to define a space therebetween so that openings in the wall section of the sleeve can vent gases produced in the mold from the metal while controlling the decomposition of the paper sleeve from casting heat. Preferably, each paper sheet has edges inclined at an angle to the longitudinal centerline of the sleeve and the edge of one sheet is offset from an adjacent edge to define a space therebetween with the space continuing the length of the sleeve to define the vent which retards burning of the sleeve. Preferably, the paper sheets are wrapped in the form of a spiral extending around the longitudinal centerline of the cylindrical sleeve with each spiral defined by the width edges of each paper sheet such that the edge of one spiral is spaced apart from the edge of an adjacent spiral to define the space.

In accordance with another important feature of the invention, the paper sheets or laminations of the sleeve are sprayed with a fire or flame retardant. Importantly, the concentration of fire retardant, which is a conventional retardant, is controlled and correlated to the temperature of the molten metal such that the paper will not ignite nor burst into flame, but, as a function of a particular time during which the sleeve is exposed to the casting heat, the sleeve will decompose into a harmless carbon ash. The time period at which decomposition begins is long enough to allow casting solidification. Significantly, the carbon ash prevents no impediment to the sand reclamation system and requires no special precautions.

In accordance with another specific feature of the invention, only glue is applied to the paper ply or lamination which forms the inside diameter of the sleeve and, similarly, only glue is applied to the outermost paper ply or lamination which forms the outside diameter of the paper sleeve. Interior paper sheets, plies or laminations are simply wrapped, preferably tightly, around one another so that the inside diameter and the outside diameter of the sleeve can be carefully controlled within precise tolerances to permit the sleeve to be accurately applied along with the cores, if any, in the core setting station of conventional, automatic molding machines. Significantly, because of the number of paper sheets coupled with their tight wrap, a strong sleeve capable of not only withstanding pressures exerted by automatic molding machines but also any shock or jarring loads that the mold may be subjected to.

In accordance with a still more specific feature of the invention, the paper plies or laminations are wrapped about a mandrel of significant length so that a long length, cylindrical sleeve is formed which can be simply transversely cut in desired segmented lengths for mold applications.

In accordance with another aspect of the invention, a sand mold system for use in a foundry to produce cast metal articles includes the steps of providing a pattern in the form of the article having at least one thick and one thin section along with a form for a sprue, a riser and a runner. The sand is packed about the pattern to produce the cope portion of the mold and the drag portion of the mold and an article form cavity as well as sprue, riser and runner cavities. Inserted into one of the sprue and riser cavities in contact with the thick section of the casting is an insulated paper sleeve. Molten metal is then poured through the sprue and feeds the thick section of the article form cavity through the thin section. The paper sleeve maintains at least a portion of the mass of the molten metal in a liquid state for a time period which is long enough to insure adequate solidification of the metal in the thick section of the article form cavity without developing significant chills in the thick section as the metal cools. Thereafter, the sleeve is reduced to a carbon ash by the heat of the metal casting after the time period has elapsed, thus permitting the volume of the metal contained within the sleeve to be reduced to a lesser volume than that which is otherwise possible. Finally, the sand from the sand mold is reclaimed along with the carbon ash. In accordance with another aspect of the system, the sprue feeds the riser sleeve which feeds a thick section of the casting. The sprue does not otherwise feed the article form cavity which is provided with a vent for venting gases from the cavity when the casting is poured. Thus, a riserless sand mold is produced. The sleeve, because of its high K factor, not only feeds the article form cavity but also functions as a riser.

It is thus a main obJect of the invention to provide an insulating sleeve for sand mold application which is significantly less expensive than conventional, riser sleeves.

It is yet another object of the invention to provide an insulating riser sleeve which has a significantly better insulating or K factor than existing riser sleeves.

Still yet another object of the invention is to provide an insulating riser sleeve which does not contaminate the mold sand so as to permit reclamation thereof without the need for any special precautions.

Yet another object of the invention is to provide an improved riser sleeve which can be manufactured within tight dimensional control tolerances so as to permit its application to automatic molding machines.

Yet another object of the invention is to provide an improved insulating riser sleeve which increases the capacity of existing automatic molding machines to permit larger castings to be formed therein than what is now possible.

Yet another object of the invention is to provide an improved insulating riser sleeve which saves metal, increases foundry capacity, reduces energy cost and/or saves finishing time.

Still yet another object of the invention is to provide an improved riser sleeve which has a high columnar strength to permit stacking one on top of the other in storage and shipping.

Still another object of the invention is to provide an improved insulating riser sleeve which can be stored without any need for taking precautions to control the moisture content thereof.

Still another object of the invention is to provide one type of insulating riser sleeve which can be used, without any modifications for steel, ductile iron, white iron, copper, aluminum and brass castings.

Yet another object of the invention is to provide an improved riser sleeve that can handle loads in excess of about 1600 psi which is far in excess of the 1200 to 1400 psi used in automatic molding machines as the molds are constructed and the covers and risers set.

Yet another object of the invention is to provide a riser sleeve as a production item in lengths up to twenty feet long, ID's from $\frac{3}{4}''$ to 32", OD's from $1\frac{1}{4}''$ to 36" so that the sleeves could be cut to desired application length thereby reducing overall costs of producing the sleeve.

Yet another object of the invention is to provide an improved system for casting metal articles by sand molds.

Still yet another object of the invention is to provide an improved system for sand casting metal articles which eliminates the need for risers.

These and other objects of the invention will become apparent to those skilled in the art upon a reading and understanding of the detailed description of the invention as set forth below.

BRIEF DESCRIPTION OF THE DRAWINGS

The invention may take physical form in certain parts and arrangement of parts, a preferred embodiment of which will be described in detail and illustrated in the accompanying drawings which form a part hereof wherein:

FIG. 1 is a schematic pictorial representation of the insulated sleeve of the present invention;

FIG. 2 is an elevation view showing the first ply or lamination of the insulated sleeve wrapped on a mandrel;

FIG. 3 is a schematic illustration of a portion of the wall section of the insulated sleeve of the present invention showing a typical orientation of several plies or laminations thereof;

DETAILED DESCRIPTION OF THE PREFERRED EMBODIMENT

Figure 4:
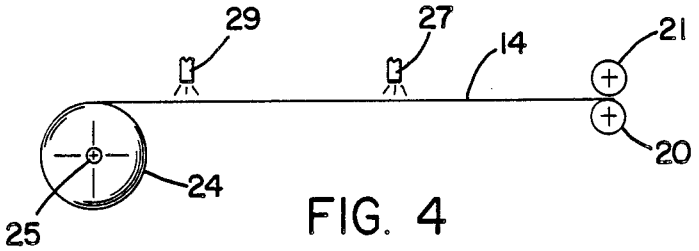
FIG. 4 is a schematic illustration of a process used to manufacture the insulated sleeve.

Referring now to the drawings wherein the showings are for the purpose of illustrating a preferred embodiment of the invention only and not for the purpose of limiting the same, FIG. 1 shows an insulated sleeve 10 which, in the preferred embodiment, is generally cylindrical and which extends lengthwise about a longitudinal centerline 12. Sleeve 10 has an inside diameter and an outside diameter, so that the difference therebetween defines the wall thickness shown as T of the sleeve. Wall thickness T is comprised of sheets or plies of paper 14 wrapped about each other and around longitudinal centerline 12. Each wrap may be viewed as a lamination. The weight of the paper, its density or porosity and its thickness have a bearing on the performance of sleeve 10. The paper is relatively thick having a thickness of anywhere between about 0.0025 to 0.0035" and a weight or density of about 0.0025 to 0.0035 pounds per inch. The heavier the paper, the more pulp fibers per inch and consequently less space therebetween rendering the paper more resistant to burning than what otherwise would occur. As to the sleeve dimensions, the inside diameter of sleeve 10 would be produced in approximately ¼ inch increments from ¾ inches to 30 inches and the thickness of the sleeve would, depending upon the application, vary anywhere from ¼ inch to 2½ inches with smaller thicknesses T associated with the smaller ID and larger thicknesses T associated with larger ID dimensions. The number of plies or laminations of paper sheets 14 in the sleeve, i.e. the number of wraps would not exceed about 60 wraps. In theory, one wrap could make up sleeve 10.

Referring now to FIGS. 1, 2 and 3, the wrapping of paper sheets 14 is a particularly important feature of the invention. Essentially, the sheets 14 are tightly wrapped about a cylindrical mandrel 16 which has an outside diameter equal to the inside diameter of sleeve 10. Each paper sheet 14 is a continuous strip having a defined width W which in turn is the spacing between parallel edges 17, 18 of the continuous strip of paper 14. The paper sheet 14 is wrapped about mandrel 16 which has a length of about 20 feet. Since the paper width W is about 4" to about 5" and mandrel 16 is about 20 feet, paper sheet 14 must necessarily be wrapped as a spiral or helix (preferably spiral) about mandrel 16 and around longitudinal centerline 12 in the arrangement generally illustrated in FIG. 2. Importantly, for reasons which will hereafter be explained, the spiral is wrapped so that there is a space, "S", between adjacent edges 17, 18 of paper sheet 14. The space "S" can vary anywhere from about ¼" to about 1½" and is smaller for smaller ID sleeve 10 and larger for larger ID sleeve 10. The angle "A" which paper edge 17, 18 makes with longitudinal centerline 12 of sleeve 10 is not believed especially critical but is preferably about 5°–60°. More specifically, the small diameter sleeves would have a wrap angle of 5° which would be progressively increased to about 60° (even 70°) for the larger sizes. Paper sheet or ply 14 is wrapped tightly in the configuration shown in FIG. 2 about and along the total length of mandrel 16. Then another paper sheet 14 is wrapped in an overlying relationship over the first sheet so that the width of the second sheet will overlap the space of the first sheet. This is diagrammatically shown in FIG. 3 where the first paper sheet **14*a* is shown with its space $S_a$ covered by the second sheet 14*b* having a space $S_b$ which in turn is covered by the third sheet and so on until the last sheet $\mathbf{14}_n$ is formed. For definitional purposes, the ID of sleeve 10 is defined by first sheet $\mathbf{14}_a$ and the OD of sleeve 10 is defined by last sheet $\mathbf{14}_n$. Obviously, one width W of paper sheet 14 can be used to construct sleeve 10. In practice, two different sheet widths "W" are used in the wrapping of sleeve 10. One sheet 14*a*, 14*c*, 14*e*, etc., has a width of 4" and the other sheet 14*b*, 14*d*, 14*f*, etc. has a width of 5". The differential in the width "W" allows the second 5" sheet 14*b*, etc. to overlap space "S" in the first sheet 14*a*, etc., and permits sleeve 10 to be simultaneously double wrapped during its formation. This is shown in the overlap construction of 4" paper sheet 14*a* by 5" paper sheet 14*b* in FIG. 2. The overlapping relationship of the spaces S permits sheets of paper 14 to be wrapped tightly. Glue is applied preferably only to the outside surface of the first sheet or ply of paper $\mathbf{14}_a$ and the inside surface of the last sheet or ply of paper $\mathbf{14}_n$. The overlap and the minimum use of glue permits sleeve 10** to be formed at carefully controlled OD and thickness T tolerances. Total tolerances in this regard can be controlled within 0.005, i.e. ±0.0025 inches. This is an important aspect of the invention which will be further discussed below.

When sleeve 10 has been formed, it is simply pushed off mandrel 16 and takes the shape of sleeve 10 in FIG. 1. It has a length of about 20 feet. Sleeve 10 is then cut into desired riser lengths or segments, **10*a*, 10*b*, etc., as indicated by the dash lines in FIG. 1. The height of the segments will typically vary anywhere from about 2 inches to 20 inches. The angle A of the spiral is shown in FIG. 2 and the spacing S is chosen so that irrespective of the size of segment 10*a*, 10*b*, 10*c*, etc., each space S will at least wrap about 180° of the circumference of sleeve 10 irrespective of where segments are taken. It is, of course, appreciated that any spiral will result in a space S which will extend the length of any sleeve segment 10*a*, 10*b*, 10*c***, etc.

Referring now to FIG. 4, there is diagrammatically shown a general arrangement showing the concepts used in manufacturing sleeve 10. Essentially, paper 14 is conveyed through a drive roll 20 and a driven roll 21, one of which is mandrel 16. Paper sheet 14 is fed from a roll 24 which is mounted on an axis 25 which is tensioned so that paper 14 is slightly stretched as it is wrapped in the drive-driven roll. Either axis 25 or the axis of drive and driven rolls 20, 21 is angled relative to the other so as to produce the desired spiral. This arrangement is substantively the same as that in conventional use by manufacturers of paper tubes around which gift wrapping, calendars, etc. are wrapped. When sleeve 10 is double wrapped as discussed above from paper sheets 14 of two different widths "W", two rolls 24, vertically offset from one another are used. It is known in the tube forming industry that paper 14 undergoes a slight increase in tensile strength if wrapped at an angle relative to mandrel 16 than if wrapped simply at right angles to longitudinal centerline 12. It is also known that rolls 20, 21 compress paper sheets 14 to an even thickness dimension. The result of the wrapping arrangement in FIG. 4 is that cylindrical wall section T can be manufactured to a tightly controlled tolerance. As noted above, a glue nozzle 27 is provided to spray the first wrap $\mathbf{14}_a$ and the last wrap $\mathbf{14}_n$. Thus, the glue does not distort the thickness T of sleeve 10. Also, the wrapping arrangement produces a very tight wrap which increases the columnar strength of sleeve 10 permitting stacking for storage and transportation purposes and application to automatic molding machines.

A nozzle 29 is also provided to spray paper sheet 14 with a fire retardant. The fire retardant can be any conventional retardant used in treating paper and a retardant which has worked satisfactorily for sleeve 10 is commercially available under the brand name Borox and preferably is applied in a 20% Borox-water mixture. The heat from mandrel 16 dries the moisture introduced into paper sheet 14. The terms "flame retardant" and "fire retardant" are used interchangeably herein. What is meant is a retardant which prevents the item treated from igniting and producing a flame. Sleeve 10, as manufactured, is intended for use as a riser sleeve for steel, white iron, ductile iron, brass and bronze and aluminum castings. Liquid temperature and the temperature at which such metals are poured varies. Nevertheless, it has been found that sleeves 10 will work in a satisfactory manner to be described if the retardant is sprayed relative to the highest liquid melting temperature of the metals described, i.e. 3500° F. The retardant is sprayed onto paper sheets 14 in a concentration which is sufficient to prevent the sleeves from bursting into flame when exposed to metals at that temperature but, which is of not such a concentration to prevent the paper from decomposing at that temperature over a period of time. More specifically, sleeve 14 must decompose or reduce to a pure carbon ash after being exposed to the molten metal only after a certain period of time has elapsed. The reducing or decomposition temperature may, in fact, be less than 3180° F. Generally, the concentration of the retardant must be sufficient to prevent sleeve 10 from spontaneously igniting or burning when subjected to an open flame but the concentration must not be so high that as a function of time for a given temperature, the effectiveness of the retardant diminishes such that sleeve 10 reduces, again without igniting, into a carbon ash. Theoretically, the concentration should be matched to the liquid temperature at which the particular metal is cast. However, as of this time, adequate results have been obtained by maintaining one retardant concentration and testing paper sheets 14 by simply exposing the sheet to an open flame from a blow torch for several seconds. The concentration of retardant is deemed sufficient if paper sheet 14 does not ignite but does singe or blacken under the flame which, again, is held on the sheet for 2 to 3 seconds.

Figure 5:
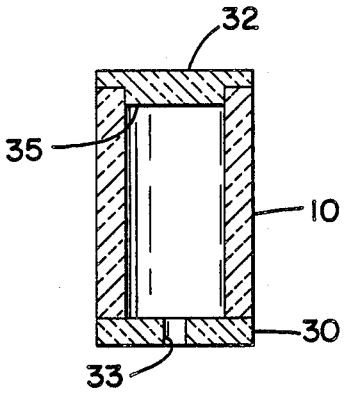
FIG. 5 is a sectioned elevation view of a sleeve with attachments.
Figure 6:
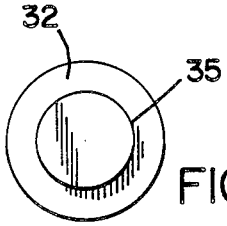
FIG. 6 is a plan view of a cap attachment.
Figure 7:
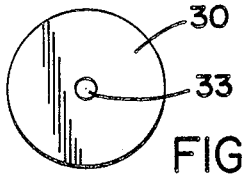
FIG. 7 is a plan view of a reducer attachment.

Referring next to FIGS. 5, 6 and 7, FIG. 5 shows sleeve 10 with accessories which includes a reducer 30 and a cap 32. Reducer 30 and cap 32 are, per se, conventional in function since both items were developed and used on the Brown Insulating Sleeve. Reducer 30 is positioned adjacent the article forming cavity in the sand mold to provide a smaller metal mass to remove from the casting when the riser is cut away in the finishing operation. Cap 32 is an attachment used to cap open risers and blind risers to better maintain the insulating characteristics of sleeve 10 while keeping foreign matter out of sleeve 10. Reducer 30 and cap 52 are described as accessories since they do not have, as their function, the maintenance of the metal in a liquid form but are used to enhance applications of sleeve 10.

When used in the invention, reducer 30 is a disk having the same OD as that of sleeve 10 but with a small central opening 33. Reducer 30 is made from paper in one of two forms. First, it can be manufactured in the same manner as that of sleeve 10 with openings S between each of its paper plies it and the paper treated with retardant. An alternative design which has worked is to use a very porous paper cut into circular sheets with circular central openings which, after being treated with flame or fire retardant, are serially stacked one on top of the other until a desired thickness has been obtained. The sheets are not glued but simply pressed together into a free standing form which is not compact, at least when compared to the compactness of tightly wrapped sleeve 10. The form is retained by the porosity and thickness of the paper sheets making up the reducers. Paper of the type used as a blotter for ink from fountain writing pens has proved acceptable. The porosity of the paper, coupled with the "looseness" of the stacked assembly and the relatively small thickness thereof (when compared to the length of sleeve 10 typically used in a riser application) permit reducer 30 to function in a manner similar to sleeve 10 as hereafter explained and under the same principles. Specifically, the porosity and looseness permit reducer 30 to evenly combust once the effectiveness of the retardant has been spent. The reducer paper construction would not be acceptable as a form for sleeve 10 or at least for sleeves longer than about 2–3 inches in length.

Cap 32, when used with sleeve 10, is shaped as shown as a circular disk having an OD equal to the OD of sleeve 10 which it caps and an ID equal to the diameter of boss 35 which in turn is equal to sleeve 10. The fit between boss 35 and sleeve 10 is carefully controlled so that when cap 32 is applied to sleeve 10 it stays in place. This permits the application of cap 32 to sleeves 10 which function as blind risers. In certain applications such as those involving Hunter automatic molding machines, cap 32 is needed in a blind riser application to prevent sand from entering sleeve 10. It is not critical to the operation of sleeve 10 when sleeve 10 functions as an open riser that cap 32 be provided in the insulating sense. That is, the casting is fed from the bottom of sleeve 10 and cap 32 is simply to slow the cooling of the metal at the top of sleeve 10. Sleeve 10 could be made from porous blotter type paper as described for reducer 30. Alternatively, cap 32 could be simply formed from loosely packed foundry sand held in a porous form by means of an appropriate binder. Cap 32 could then be reclaimed along with the rest of the foundry sand during shake-out.

It is important that both cap 32 and reducer 30 "breathe".

Figure 10:
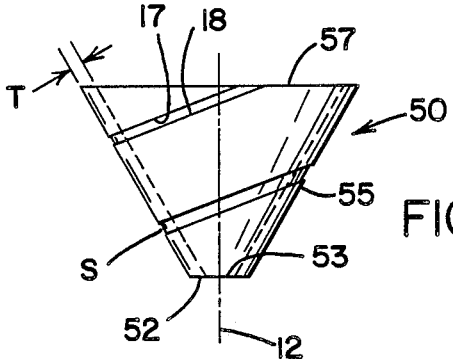
FIG. 10 is an alternative embodiment of the form of the insulating sleeve of the present invention.

Referring now to FIG. 10, there is shown an alternative embodiment to the cylindrical sleeve shape wherein sleeve 10 is shown as a truncated cone 50. Truncated cone sleeve 50 is made from paper plies or sheets in a manner similar to that described for cylindrical sleeves 10 except that truncated cone sleeves 50 would have to be individually wrapped on a mandrel shaped as a truncated cone, i.e. it is not possible to cut the cone to length as it is with the cylindrical sleeves. The cone would be wrapped so that a spiral space S is provided in the same manner as done for the cylindrical sleeve 10. In the prior art ceramic sleeves, a truncated cone sleeve was developed for mold applications where the mold space did not permit installation of a cylindrical sleeve. Similarly, a tapered or truncated cone sleeve 50 is envisioned as a paper sleeve to achieve a maximum reservoir with minimum contact area with the metal forming cavity. In the cone 50 in FIG. 10, the base 52 has an opening 53 which provides a minimum contact area which in diameter equals ¾" to 3". The taper of the sleeve wall 55 with respect to longitudinal axis 12 is about 30°. The sleeve wall thickness T is about ¼" to 2½" and the cone height would be about 3" to 16". The sleeve opening at the top 57 of cone 50 could be fitted with cap 32.

In the development of the sleeve, it was found that a tightly wrapped paper sleeve could function as an insulating riser sleeve only if there was a vent or a series of vent passages S through sleeve 10. Preferably, the passages S extend the length of sleeve 10 although, in theory, they could extend radially. In addition, the sleeve must be treated with the fire retardant in the manner described above. When developing sleeve 10, it was found that a tightly wrapped sleeve without the spaces S, and preferably a space S between each ply or sheet, or without a proper amount of fire retardant would simply not produce an adequate sleeve. While it is not precisely known why a space S or a vent groove sleeve 10 is required, it is believed that space S is necessary to permit sleeve 10 to decompose or reduce itself to carbon ash uniformly over a timed increment when it is exposed to the heat from the casting in the mold. Without spaces S, a phenomenon known as "rat holing" can occur with the result that sleeve 10, or at least a portion of sleeve 10, ignites, even with retardant, and burns or decomposes more rapidly than the other portions of sleeve 10 thus destroying the insulating characteristics of sleeve 10. The spaces S are believed to prevent this by subjecting paper sheets or plies 14, i.e. the interior of the wall thickness of sleeve 10, to the heat from the metal instead of just the inside of sleeve 10 so that sleeve 10 can decompose uniformly without developing any hot reaction areas which could force the sleeve to decompose in an out of control manner. Additionally, spaces S also provides a venting of the gases through the sleeve wall thickness, a feature not present in prior art Brown ceramic insulating riser sleeves. It is also believed that the spaces S make sleeve 10 more tolerant to application variations in fire retardant concentration applied through nozzle 29 to any particular sheet or ply 14. Further, it is noted that a space S exists between each ply or sheet of paper 14 inherently as a result of the process employed to wrap paper sheets 14 into sleeve 10. This is preferred. However, the invention may function, that is the heat reaction could still be controlled, if the space S were provided between every second or third ply although, this is a theoretical point and is simply mentioned with respect to what is believed is occurring in sleeve 10 from a heat of reaction point-of-view.

With respect to the auxiliary items or accessories, and specifically reducer 30, a space S between reducer plies or sheets of paper must be provided. If not, reducer 30 will, as with the sleeve, decompose unevenly under the casting heat. As noted above, space "S" for the reducer 30 comprises, however, porous paper sheets pressed together in a loose free-standing form. The porosity plus the looseness of the assembly permits the reducer to breathe so that the reaction heat uniformly decomposes reducer 30. Because reducer 30 has a small axial length, it is not necessary that it have the rigidity and strength which is required for sleeve 30. On the other hand, cap 32 principally functions as a plug to keep sand and other foreign matter out of the riser and secondarily as a means to prevent heat from leaving the top of the sleeve. Thus, cap 32 could, in theory, ignite and burn prior to decomposition of sleeve 10. Cap 32 is preferably formed from the blotter paper construction used for reducer 30. The looseness of this type of construction permits the cap to vent gases from the liquid metal in sleeve 10. Alternatively, a loosely packed foundry sand-binder mixture can be compiled to make cap 32. The sand would not be packed so hard as to prevent free venting of the gases through cap 32. It is also even possible to use loosely packed foundry sand as a reducer. As noted above, the accessories are not designed as insulators as is the case for sleeve 10. Thus, the accessories could be made from sand so long as gas venting through the sand can occur. When the accessories are made from paper, venting and uniform or even combustion of the paper should be provided. Also, reducer 30 is preferably made from paper to insure that the metal in opening 33 is insulated.

Sleeve 10 as thus described, operates in a similar manner as the prior art Brown ceramic insulated riser sleeve. Sleeve 10 of the present invention affords the following additional benefits when compared to the prior art Brown ceramic insulating sleeve:

(a) Obviously, the price of sleeve 10 is materially reduced when compared to the price of a ceramic sleeve (or an exothermic sleeve for that matter) and this is especially important in the castings industry where fractions of a penny a pound for a casting determines whether or not a foundry does or does not obtain an order.

(b) Unlike the ceramic sleeve, sleeve 10 is not sensitive to moisture. Prior art ceramic sleeves had to be stored in a room where the moisture of the room was controlled to prevent adverse affects on the composition of the ceramic sleeve, i.e. the binder. Moisture could affect the performance of the ceramic sleeve and could also affect the intermingling of the ceramic sleeve with the foundry sand in the reclamation process. As noted several times, while sleeve 10 of the present invention is functioning as an insulator in the same way that the ceramic insulating sleeve functions to generate a liquid column of metal, the manner in which this is accomplished is markedly different. The ceramic sleeve shape did not change after the casting was poured, and the ceramic sleeve was simply ground up and mixed with the foundry sand and reclaimed in the sand reclamation process. In the present invention, it is necessary that sleeve 10 be consumed because unburnt paper cannot be reclaimed with foundry sand. Thus, sleeve 10 is operating in a time/temperature relationship to maintain its integrity and its insulating characteristics for a time sufficient to permit the metal in sleeve 10 to feed the casting as a riser but once this time has passed (that is, once the casting has solidified) the heat from the metal in the riser and from the casting will so consume the retardant that sleeve 10 will then gradually decompose or reduce and in this connection, spaces S permit the entire reduction process to proceed uniformly so that sleeve 10 turns into a white carbon ash which can be reclaimed with the foundry sand since it causes no damage to the sand. This is an essential point of the invention. Because of this concept, an open riser can extend beyond the sand mold and can be filled with metal which does not go to the top of the sleeve, but the heat from the mold in time will decompose or reduce that portion of sleeve 10 sticking above the mold, not filled with metal, to a carbon ash which then can be reclaimed in conventional sand reclaiming operations in the foundry. The reclamation process, per se, is not part of the invention but the fact that conventional reclamation equipment can be used with sleeve 10 is an important aspect of the invention. The foundry practice, after casting solidification, is to "shake out" the casting from the mold and break up the foundry sand into small particles to permit it to be reused without contamination. After shake out, the sand particles are passed through screens of various mesh sizes to insure that sand and not agglomerates is reclaimed. Upon shake out, sleeve 10 should be completely consumed. The carbon ash (i.e., the consumed paper) will, for the most part, become a powder having a particle size in the 300 plus mesh range. Particles or fines in this range are removed by the vacuum system located over the shake out area. Thus, no contamination of the sand system is possible. Any ash of a smaller size which is not removed by the vacuum system has no deleterious effect on the sand system. It is noted that after shake out, the foundry sand is typically screened at a small mesh range of 80–120.

(c) The K factor of sleeve 10 when compared to ceramic, insulating riser sleeves, during the time that sleeve 10 is functioning as an insulator (prior to its decomposition) is greater by a factor of 2–4 times. Specifically, the K factor (the insulating value which could be expressed as an R number) for sleeve 10 has been determined as 0.051 which compares to 0.072 of the ceramic sleeves. This permits a greater reduction in the size of metal risers than that previously afforded. As noted below, the K factor is a heat transfer value commonly used in foundry practice. Other values such as the R co-efficient used in insulation could also be employed to express the insulating characteristics of sleeve 10.

(d) Because paper sheets or plies 14 are tightly wrapped, and because, preferably, glue is only applied to the first and last sheet, the tolerances, specifically, the OD, the ID and the thickness T can be controlled, as noted, to a total variation of 0.005 inches. The sleeves 10, as a column are relatively strong and rigid and can support a column load of 1600 psi. With ceramic insulating riser sleeves, special precautions have to be taken in the packaging and shipping of the sleeves to individually wrap and protect each sleeve from breakage during transport and storage. None of such precautions are required for sleeve 10. In addition, the ceramic sleeves could not be applied to any installation where they would be subjected to high stress loads.

The dimensional preciseness and strength of sleeve 10 and the exceptional K factors obtained permit sleeve 10 to be applied to automatic molding machines and furthermore permit radical changes to conventional risering and gating techniques.

Conventional automatic molding machines such as the Hunter machine or the Diesamatic® molding machine do not, per se, form part of the invention. However, the application of sleeve 10 to such machines and the manner in which sleeve 10 can affect gating and risering techniques used with such machines does comprise a portion of the invention. Automatic molding machines conceptually produce a defined volumetric shape typically by means of a pattern plate at one end of a volumetric space and a pattern at the other end of the shape. Foundry sand under pressure is then packed into the space to produce a cope or a drag portion of a sand mold. Cylinders and linkages are used to permit the pattern or the pattern plate to be swung away from the mold while the other plate pushes the formed mold out of the sand packing station and then the pattern and pattern plate retract to their initial mold forming condition for making the next sand mold. The cope and drag portions of the mold are conveyed to a core setting station where the cores are set and gates are positioned and the molds joined together by accurate locators or studs. The assembled mold is then conveyed to a pouring station where the casting is produced. The core setting station is an important part of the automatic mold machines and there is some variance in the processes. Basically, the cores are situated in a frame mask. The frame mask is precisely positioned relative to the mold. Vacuum or air is then used to remove the cores from the core frame and automatically position the cores at the desired precise point in the article forming cavity of the sand mold. Heretofore, the tolerances associated with prior art ceramic sleeve risers relative to the location of the pattern, the pattern plate and the core frame, prevented the use of prior art sleeves with automatic molding machines since there was no way to accurately and automatically position the prior art sleeves in the mold making process, given the dimensional variations of prior art sleeves. Significantly, automatic molding machines set the cores and join the mold halves together rapidly and with considerable force and pressure, typically about 1200 to 1400 psi as noted above. Prior art ceramic insulating riser sleeves cannot withstand such forces.

Accordingly, risers used in automatic molding machines are conventional sand form cavities constructed in accordance with normal conventional foundry technique. This is illustrated, for example, in the application manual published by Disa Dansk Industri Syndikat A/S for use with its Disamatic® automatic molding machines. In Disa's 1984 application manual, a section on risering technique is presented with a notation that a well designed risering system in combination with a proper gating system will significantly reduce the number and size of necessary feeders. Disa recommends an imperical formula as set forth below in which the module of the solidification of the riser Mr is depended upon the module of solidification of that part of the casting $M_c$ which has to be fed by the riser multiplied by the insulating factor K in accordance with a conventional known formula: $M_r \geqq K \times M_c$. K is said to be determined experimentally and is given as values for various materials from 0.6 to 1.4. This K factor is based on the sand acting as a chill. The discussion continues and it is noted that 2 geometrical shapes, i.e. a sphere or a cylinder are chosen as a standard riser shape because the riser must have a shape which gives it a maximum metal value with a minimum surface heat extracting area. That is, heat is lost through conduction from the riser to the sand. Thus, the riser shape (cylinder or sphere) is selected to give the least surface area while retaining the greatest mass volume. This risering concept is applicable to hand-packed sand molds as well as sand molds formed by automatic molding machines. Substituting for the K factor the K factor of 0.051 obtained with the insulating sleeve of the present invention illustrates the significant reduction which can be obtained in $M_r$ by use of sleeve 10. Because of the tolerances and strength of sleeve 10, sleeve 10 can be fitted into the core mass frame of the automatic molding machines and set in the mold when the cores are conventionally applied. Because automatic molding machines are limited to casting size depending upon the size of the pattern plate, and because the gating, feeders and risers take up a portion of the pattern plate space, sleeve 10 permits a larger article forming cavity to be made by the pattern plate than what is otherwise possible today because the riser size is reduced.

Figure 8:
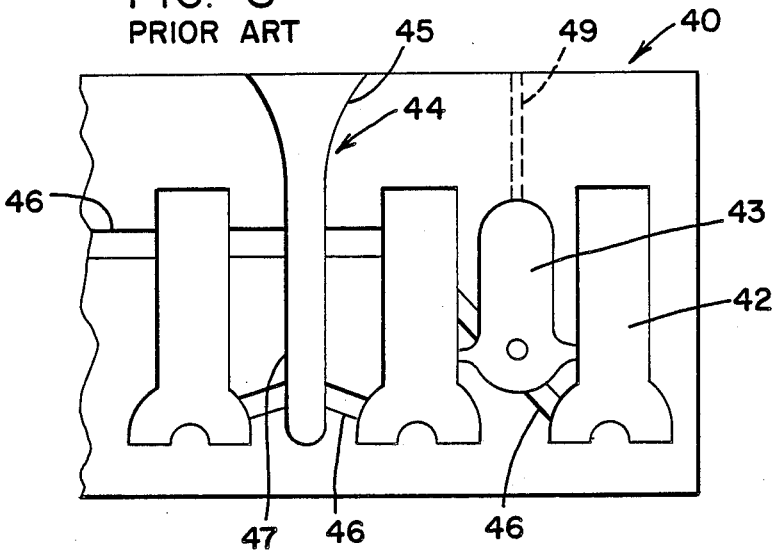
FIG. 8 PRIOR ART
FIG. 8 is a schematic plan view of a sand mold at the parting line such as formed by an automatic molding machine and typical of a prior art casting.
Figure 9:
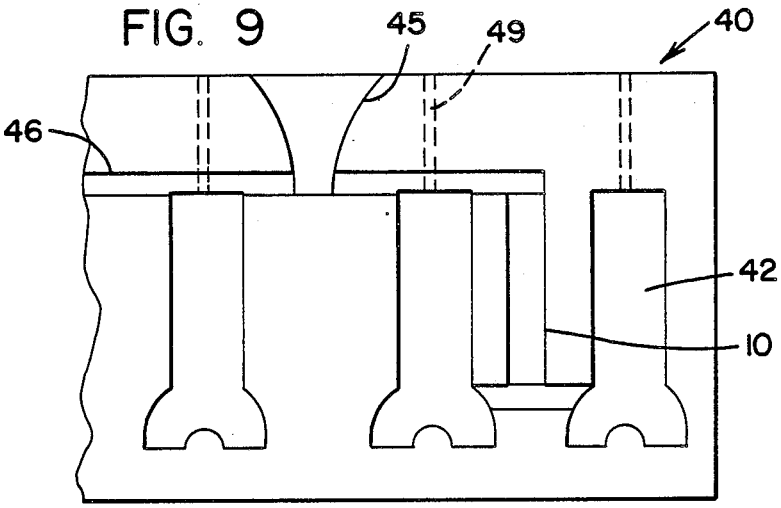
FIG. 9 is a view of the mold of FIG. 8 modified pursuant to the system of the present invention.

Referring now to FIGS. 8 and 9, there is shown in FIG. 8, schematically, the drag portion 40 at the parting line of a sand mold formed by a Disamatic® molding machine and FIG. 9 illustrates the same mold modified in accordance with the invention. The mold illustrated has four article forming mold cavities 42, only three of which are illustrated so that each mold produces four cast articles. A sprue 44 feeds liquid metal to article forming cavities 42 and as article forming cavities 42 fill with molten metal, a riser 43 (FIG. 8) is also filled. Riser 43 is sized and positioned relative to the thickest part of article forming cavity 42 so that upon cooling of article forming cavity 42, liquid metal is drawn from riser 43 to prevent shrinkage. The size and shape of riser 43 is determined as noted above. Sprue 44 includes a conventional pouring cup 45 which by means of runners 46 and a feeder 47 introduce the metal into article forming cavity 42. Because riser 43 illustrated in FIG. 8 is a blind riser, a vent tube 49 is provided to permit the gases produced by the hot liquid metal to be vented out of the sand mold.

Now in accordance with the invention, riser 43 can be simply replaced with paper sleeve 10 of the invention to accomplish the aforementioned purposes, i.e. metal reduction, etc. However, because of the excellent insulating characteristics of sleeve 10, it has been discovered that sleeve 10 could also function as a feeder as well as a riser. That is, the riser as a separate mass of metal formed by metal flowing through the cavity into a receptacle and from the receptacle back into the cavity to supply make up metal to compensate for volumetric shrinkage need not exist. The metal from the feeder itself can retain its liquidity for a time period sufficient to provide additional metal to article forming cavities 42 to make up the metal mass lost due to volumetric contraction in article forming cavity 42. This is illustrated now in FIG. 9 where sleeve 10 has replaced riser 43, feeder 47 and a good portion of the runner 46. A vent tube 49 is also provided to the article forming cavity 42 so that the gas in article forming cavity 42 may escape. Thus, in FIG. 9, metal is poured through pouring cup 45 and is then fed into article forming cavity 42 from sleeve 10 and when the metal in article forming cavity 42 solidifies and contracts, metal from sleeve 10 which is still liquid will supply make up metal for article forming cavity 42. This concept will have a tremendous impact on foundry methods. Depending upon article forming cavity design, it is now possible to feed the cavity at its thickest point and have the feeder function as the riser to eliminate any need for a separate riser as it exists today. A riser, as it now exists, will only be required when the intricacy of the casting design necessitates that a thin section must feed a thick section, and in that instance sleeve 10 can function simply as an insulated riser. In accordance with the discussion above, sleeve 10 remains in its paper sleeve form during the time the casting solidifies and then sleeve 10 disintegrates into a carbon ash which is substantially removed during shake out and reclamation of the sand.

The following sets forth a further description of the application of sleeve 10 to a casting in a foundry and supplements the description given above. The statements set forth below are those of one of the inventors of this invention, Robert Brown, and the statements were made to prospective purchasers of the prior art Brown insulated ceramic riser sleeves. The comments below, while directly applicable to the prior art ceramic insulated sleeve are also applicable to the present invention insofar as the application of sleeve 10 as an insulated riser is concerned.

A. THE BASIC CONCEPTS

1. The rate of heat transfer varies in direct proportion to change in temperature differential, all other factors being constant.

2. The K factor of any material or metal is the BTU/hr/ft$^2$/ft/1°ΔT. (Sometimes this is given as ft/2H/inches in which case the K factor numerically is 12 times higher.)

3. The casting has much greater area in contact with the sand of the mold, than the riser metal has surface in contact with the sleeve cap and insulating reducer.

4. The K factor of densely compacted foundry sand varies from 0.6 to 1.2 depending on the density and moisture content.

5. The K factor of steel is 22+ at high temperature or 300 times, that of the material of Brown insulating products (0.072=K Brown).

6. Every other factor held constant, steel will pass heat 300" for each inch if it passes through Brown insulation.

7. The steel solidified and chilled below the melting point is much lower in temperature than the highly insulated riser metal; so that heat will flow from the riser to the coldest part of the casting, the sand metal contact in mold.

8. The molding sand is at a much lower temperature than the coldest casting metal hence the heat forced by temperature differential to this coldest section is in turn picked up by the sand.

9. The metal cross section of the casting becomes larger as heat passes farther from the riser at the rate of two times the distance from the riser base.

10. As the cross section of steel increases, the flow of heat through it increases in direct proportion. All other factors held constant.

11. This cross section of the steel casting necessarily becomes many times the area of the aperture in the Brown insulating reducer.

12. All of the above factors are so favorable to heat loss through casting to molding sand that this has to be the largest path of heat loss from the riser.

13. In order to contemplate a liquid riser, it is obvious that the contact area between the riser and the casting must be held at minimum—the Brown insulating reducer is an absolute requirement.

14. Once the concept of a liquid riser becomes possible through the Brown insulating system of insulating sleeve, cap and reducer, the study of risering becomes a hydraulic problem.

15. If the riser metal is held liquid until the feeding of the casting is complete, then the optimum in reduction of riser metal can become a fact.

16. Thus by the simple expedient of using the Brown Liquid Riser concept it is possible to increase the productivity of a foundry both as to size of casting which may be poured and the total pounds poured into saleable castings by 20–50% with no increase in melting capacity.

17. In effect, it makes the total foundry investment that much more productive.

B. AN APPROACH TO THE INTRODUCTION OF THE BROWN LIQUID RISER CONCEPT TO A FOUNDRY

1. The very worst that can happen is to have a foundryman use the process without a carefully planned test program to determine the safe application to his particular foundry.

2. If common risers have been currently used, a first step would be to use insulating sleeves alone on a casting on which common risers have been successful.

3. Use a sleeve with an ID which will fit inside the common riser cavity.

4. Cover the riser with a Brown insulating cap for that size sleeve.

5. Use an insulating reducer of a size to fit under the sleeve selected.

6. Pour casting and section the riser vertically to study the shrinkage pattern.

7. Determine the weight of sound metal under the lowest evidence of piping.

8. On a second identical casting reduce sleeve size and height if necessary to eliminate one half of the weight of the good metal under lowest piping.

9. Pour casting with riser insulated by this sleeve and companion cap and insulating reduces and section riser vertically for study.

10. Determine the weight of sound metal under lowest evidence of pipe.

11. Determine the weight of this sound metal and select an insulating sleeve (diameter and height) that will contain this weight of metal.

12. Pour third identical casting with this sleeve and companion cap and insulating reducer. Section riser for study.

13. Continue the above procedure until the foundryman has determined to this complete satisfaction just how far reduction of riser can be made and yet insure faultless castings.

14. If the tests are to be run in a foundry using a competitor's exothermic sleeve or insulating sleeve, the same qualifying tests should be made except that the first test should be made with a Brown insulating sleeve the same dimensions as the competitors.

C. THE BROWN LIQUID RISER CONCEPT

1. Approximately, if necessary to have 5% in weight of the casting to be fed available as liquid metal in a riser to accommodate the liquid solidification shrinkage of the casting metal.

2. All metal in the riser above this amount is useless in so far as feeding the casting is concerned, must be cut off from the casting and remelted.

3. More important molten metal that goes into the riser is not available for casting production above this 5% factor.

4. Melting capacity must be greater for a given tonnage of castings in proportion to the weight of riser to the weight of castings. In many foundries all melting room costs are a large part due to the need for melting and delivering riser metal.

5. The larger the riser the more cost in the cleaning room to cut the larger riser from casting.

6. The limit of the size of casting that can be poured with a given melting capacity is greatly limited by the amount of riser metal that must be poured.

7. The tonnage of castings per day with a given melting capability is proportionately limited by the metal melted for riser metal.

8. If properly insulated with a Brown insulating sleeve, cap and reducer, the greater part if not all of the metal in the riser is maintained as a liquid, until the full casting requirement of feed metal is met.

9. As a liquid riser the liquid metal will leave the casting through a quite small aperture through the insulating reducer because the amount of feed is in volume very small and the time of flow relatively long.

10. Even with the full insulation of the Brown sleeve, cap and reducer concept, there will be heat loss from the riser as the insulation material absorbs heat from the riser metal plus that heat loss back through the casting and to the sand through the surface contact between the casting and sand.

11. Because of this heat loss, the metal in the riser must be sufficiently more than the 5% needed to feed the casting to have a reserve of heat content. The heat loss explained in (10) does not lower the temperature of the total riser metal below the melting point.

12. In this way, the liquid riser concept is assured and the very minimum of riser metal per pound of casting to be fed is assured. A suggested safety factor is 3 times the 5% requirement needed to feed the casting.

D. COVERS (Open Face Riser Use)

The use of Brown insulating covers to fit the OD of insulating sleeves was created to better control the heat loss through radiation from the top of risers on castings. In effect, the insulating cover minimizes the variable of the present practice in the use of exothermic compounds, insulating compounds, such as rise hulls, etc., as applied to the surface of the metal in the riser.

With the use of powdered or granular compounds applied to the surface of the metal within the riser, we have the following variables, all of which lead to tremendous heat loss, pollution, etc.

1. Uneven distribution of compound material over the surface of the metal in the riser, thus unbalanced directional solidification of the metal in the riser, and uneven solidification times from one riser to another, creating marginal results at best.

2. Variable amounts by weight of compounds applied to metal within risers, so that costs increase by excess use and problems of feed arise in light weight applications.

3. All powdered or granular compounds tend to create large cracks in the mass of compounds as the metal in the riser shrinks and begins to feed the casting. Again creating additional heat loss through radiation.

4. With the use of compounds there is always the remote possibility for this material to be sucked in the casting void as the casting calls for metal from the riser.

5. All riser compounds tend to be ununiform in composition of source of raw material used. For example, aluminum fines from smeltor operations. 2N, MG—Si, Cu. are always present, but in various amounts, plus the fact that aluminum, fines metallic content vary from day to day.

6. Except for compounds such as rice hulls, pollution is a big factory in the use of riser compounds—air pollution the big item.

So we have at least six reasons of major importance for the elimination of the use of compounds on the surface of metals in risers on castings. The same basic reasons could be extended to the use of this material in the basic steel industry with regard to their ingot mold practices.

With the use of the Brown riser cover on open face risers and in conjunction with Brown Riser sleeves, we attain the following while at the same time eliminating the variables mentioned in the use of compounds.

1. A complete insulated seal between riser and cover, uniformly controlling heat loss to a minimum.

2. Achieving directional solidification in the correct degree by a uniform dimensional correct cover each time on each individual riser.

3. The insulating cover breaths, permitting atmospheric pressure to apply, yet retaining radiation loss to a minimum. The air space between the bottom of the cover and the surface of the metal in the riser adds to the heat retention value of this application.

4. Because the Brown riser cover is of the same inert insulating material as the Brown riser sleeve, there is no pollution of the air. There is no smoke, flame or odor.

5. Because the Brown riser cover is a fabricated piece, the danger of cracks or material getting in the casting when the riser metal shrinks, is absolutely zero.

6. Uniformity of product from one shipment to another. Same exact formula at all times.

7. The Brown riser cover in open face riser use, can be nailed, or held down on the Brown Insulating riser sleeve by weights, and can be applied prior to pour.

(Blind Riser Use)

The Brown Insulating Riser Cover for blind riser application was designed to reduce the heat loss to a minimum, have a light weight but strong product, so that sand could be placed on the cover to the height of the cope without breakage to eliminate the usage of atmospheric cores and to make obsolete the present practice of sand blind riser covers of considerable thickness and weight.

The present practice of blind riser applications within foundries has these variables.

1. With the use of thick, heavy sand covers with atmospheric covers imbedded in the center of such covers, the risers furthest from the hot metal will chill the quickest. Because sand is a chill. Ununiform riser results from riser to riser.

2. Sand has no shock value when cast with a binder and will tend to spall, crack and weaken, with the possibility always present that material broken away from sand covers will get into the casting.

3. Sand covers are thick for strength and heavy to handle because of dimensions. Also brittle through the formation of the product with a resin.

4. Atmospheric cores must be made and then placed as an integral part of the sand cover, adding costs.

Again we have four major reasons to use the Brown Riser Cover, to reduce variable in blind risers to a minimum. The Brown riser cover will attain the following:

1. A light weight uniform product for each riser, can be attached to the Brown insulating sleeve, by nail. Material same as the insulating sleeve. Cover, because of its insulating value, is not a chill and will reduce heat loss.

2. The riser furthest from the introductory hot metal, with the insulating sleeve and cover, will retain the temperature at that point longer than conventional sand covers because the Brown riser cover is not a chill.

3. Elimination of the atmospheric core, because the Brown riser cover breaths and permits atmospheric pressure to work. A vent through the sand of ⅜" to the top of the cover and as near the center as possible permits directional solidification to take place properly.

4. The Brown riser cover will absorb all heat impact, shock, and will not break up and thus possibly contaminate the casting. No thermal shock.

In essence the Brown Riser Cover takes a needed second step in insulating the metal in the riser. Step #1 was the insulating sleeve. With these two steps now in production and use, the variable associated with risering castings in foundries has been substantially reduced and the savings to the foundries greatly enhanced.

E. REDUCERS

Reducer, when used in current foundry operations are made from sand and tend to be wafer thin, with metal contact openings somewhat reduced from ID of risers. Also, they have primarily been used in ductile and gray iron shops as a knockoff. Very little of this application has been used in steel alloy foundries. We find the following variables in the use of this type item:

1. Sand has no shock value with the use of the jolt machine, and many times the sand breaker cores have broken before actual pouring of metal, with the result, that no one knows where the pieces will appear.

2. Sand formed into thin wafer breaker cores, also has zero shock value, when hot metal hits it. Again it may spall or break from heat shock and where the pieces end up is anyone's guess.

3. Because breaker cores have a great deal of resin in them, gas is formed and porosity becomes a factor at the metal contact point.

4. Also the breaker sand core, is a chill initially, this is the opposite of what is desired.

5. The reduced but relatively large opening in the breaker core, permits a greater amount of heat loss into the casting from the riser than is desired, preventing any possible reduction in riser volumes.

F. VARIABLES

1. No two foundries operations and type product mix are exactly the same, however the same general behavior of molten metal exists in all shops. So we can assume that reduction of riser sizes can be obtained universally, but more in some and less in others.

2. Brown Liquid Riser Concept is a tool, which, if properly used, will give substantial savings. However, this tool must be used as directed by Brown personnel. Once the practice is firmly established, and understood, the foundryman himself will probably expand on its use and variations, within the limits of proper procedure.

3. Cope limits, flask limits, side risering, blind risering, offset risering, are all some type variable due to casting configurations. All can be dealt with through the Brown Liquid Riser concept, but no one step should be taken unless thoroughly thought out, along the lines of what makes this concept work, insulation, temperature maintenance, metal demand, heavy or thin section feed demand, etc.

4. Sand permability, determines the venting procedure, both for the sand and also to permit free gas or air flow within the complete riser concept. *Proper venting is a necessity.*

5. Metal temperature at pouring time is important and one size concept procedure should be used if the rise is near the hot metal entry and another size concept procedure for that riser which is the furthest from the hot metal entry zone and therefore relatively cool. Good judgment is needed to make adjustments. The concept can retard cooling that temperature which is provided.

6. Reducer openings on standard reducers are meant for castings that contain no sand cores adJacent to the riser, if core is present the reducer hole should be opened sufficient to properly feed the hot spot.

G. DO'S AND DON'TS

1. In the use of the insulating riser sleeve be sure to vent sand in the vicinity of the sleeve and in the case of no bake applications, vent about a third more than normal.

2. With use of the cover with the sleeve on an open feed riser, extend the sleeve approximately 1" above the surface of the cope sand and then apply the riser cover immediately upon filling riser with metal. This to vent sleeve capacity. In the case of 4 or 5 risers with covers, one riser open until completely poured is necessary. Blind riser applications, have the cover loose on sleeve with rough edge down on sleeve for venting, also vent through sand to top of cap with ⅜" rod. Do not glue or press on cap in either instances. Do not hold down with steel weights. Do not interfere with free venting around cover. Do not remove cover until shakeout. Do not use any exothermic or covering compound with cover.

3. The reducer can be used with both the open fact of blind riser, however, to insure proper positioning, we advocate nailing into the sleeve or into the sand. Coat the metal contact are with a moldwash to prevent the resin from creating porosity on casting surface. Do not glue reducer to sleeve.

H. PURPOSE OF THE BROWN LIQUID RISER CONCEPT

1. To maintain the molten metal temperature given the riser, long enough to feed the casting requirement with the minimum volume of metal.

2. To increase the number of castings per heat, through decreased metal requirements in risers.

3. To reduce run around metal from riser sources.

4. To decrease cleaning room costs, with reduced metal contact zone from risers.

5. To decrease air pollution through the use of inert covers and risers.

6. To increase furnace efficiency by making possible more saleable metal per heat.

The invention has been explained with reference to a preferred embodiment. Obviously, modifications and alterations will occur to those upon a reading and understanding of the detailed description of the invention. For instance, the invention has been described with reference to a cylindrical sleeve but it is to be understood that the invention is not limited to a cylindrical form. It is our intention to include all such modifications and alterations insofar as they come within the scope of the present invention.

It is thus the essence of the invention to provide a paper sleeve which is so constructed that it operates as an insulator for a sufficient time period to permit its use as a riser, and thus obtain all the advantages of an insulated riser, and thereafter, as a function of time and temperature, decomposes or reduces itself to a harmless carbon ash.

Having thus defined my invention, I claim:

1. A sand mold having an article forming cavity used in a foundry to cast metal articles in said cavity in combination with a paper sleeve inserted into said mold for containing a portion of the metal poured into said mold, said paper sleeve being generally cylindrical and having a wall defined by sheets of paper wrapped in overlying relationship as laminations, each paper sheet having edges inclined at an angle to the longitudinal centerline of said sleeve and the edge of one sheet offset from an adjacent edge to define a space therebetween, said space between adjacent sheets continuing the length of said sleeve whereby a plurality of vents through said sleeve is created to retard burning of said sleeve.

2. The combination of claim 1 wherein said paper is coated with a flame retardant such that said retardant is correlated to the temperature of the molten metal in said mold to permit said sleeve as a function of time and upon cooling of the metal in said old to decompose, without flaming, into a carbon ash.

3. The combination of claim 2 wherein said mold is formed by an automatic machine and said sleeve has a diameter of about ½" to 6" within a total tolerance at its O.D. of about 0.005".

4. The combination of claim 1 wherein said sleeve is a riser.

5. The combination of claim 1 wherein said sleeve is in fluid communication at one end with a section of said article forming cavity and a cap at its opposite end for closing said sleeve whereby the heated metal in said sleeve cools slower than if said sleeve is opened.

6. The combination of claim 1 further including an annular reducer at one end of said sleeve, said reducer having an inside diameter smaller than the inside diameter of said sleeve and being formed entirely of paper.

7. The combination of claim 1 further including a cap at the opposite end of said sleeve, said cap composed entirely of paper.

8. The combination of claim 1 further including a cap at the open end of said sleeve, said cap formed of loosely packed foundry sand with a binder to produce a porous cap, said cap having a circular boss adopted to be fitted into the inside of said sleeve.

9. A method for casting metal articles by use of a sand mold comprising the steps of:

(a) providing a pattern in the form of said article along with a form for a sprue, a riser, and a runner from said sprue to said article form, said riser in communication with said article form and said article form having at least one thick and one thin section;

(b) packing foundry sand about said pattern to produce the cope portion of said mold and the drag portion of said mold;

(c) inserting into one of said sprue and riser forms an insulated paper sleeve;

(d) pouring molten metal into said sprue and thus into said paper sleeve, said metal being poured through said thin section to said thick section;

(e) maintaining most of the mass of said molten metal in said paper sleeve in liquid form for a fixed time period sufficient to insure adequate solidification of the metal in said thick section of said article form without developing significant chills therein;

(f) reducing said sleeve to carbon ash by the heat of said metal after said time period whereby the size of said riser can be reduced; and (g) reclaiming said sand.

10. The method of claim 9 further including the step of providing said sand mold with a small vent form communicating with said article form whereby said mold is provided with a small vent for venting gases; and extending said runner from said riser form and said article form to said sprue; and pouring said molten metal from said sprue through said sprue runner to said article form and from said sprue to said riser runner through said riser to said article form while venting gases from said molten metal in said article form through said vent whereby a casting is produced without a riser.

11. The method of claim 10 wherein an insulated sleeve is provided in both said sprue form and said riser form.

12. The method of claim 9 wherein said cope and drag portions of said mold are produced by an automatic molding machine.

13. The method of claim 9 wherein said carbon ash is substantially removed from said sand by suction fans when said sand is shaken out of said mold.

* * * * *